US005898133A

United States Patent [19]

Bleich et al.

[11] Patent Number: 5,898,133

[45] Date of Patent: Apr. 27, 1999

[54] COAXIAL CABLE FOR PLENUM APPLICATIONS

[75] Inventors: Larry Lynn Bleich, Omaha, Nebr.; Steven John Cassady, Suwanee, Ga.; John Thomas Chapin, Alpharetta, Ga.; Philip Nelson Gardner, Suwanee, Ga.

[73] Assignee: Lucent Technologies Inc., Murray Hill, N.J.

[21] Appl. No.: 08/606,778

[22] Filed: Feb. 27, 1996

[51] Int. Cl.[6] ..... H01B 7/28

[52] U.S. Cl. ..... 174/121 A

[58] Field of Search ..... 174/35 R, 36, 174/102 R, 102 C, 110 SR, 110 PM, 110 V, 121 A

[56] References Cited

U.S. PATENT DOCUMENTS

| | | | |
|---|---|---|---|
| 3,567,846 | 3/1971 | Whippany | 174/102 R |
| 4,284,842 | 8/1981 | Arroyo et al. | 174/107 |
| 4,319,940 | 3/1982 | Arroyo et al. | 156/56 |
| 4,327,001 | 4/1982 | West et al. | 524/322 X |
| 4,401,845 | 8/1983 | Odhner et al. | 174/113 R |
| 4,412,094 | 10/1983 | Dougherty et al. | 174/110 F |
| 4,477,523 | 10/1984 | Biggs et al. | 428/389 X |
| 4,500,748 | 2/1995 | Klein | 174/121 A |
| 4,510,348 | 4/1985 | Arroyo et al. | 174/121 A |
| 4,515,992 | 5/1985 | Gupta | 174/102 R |
| 4,595,793 | 6/1986 | Arroyo et al. | 174/121 A |
| 4,605,818 | 8/1986 | Arroyo et al. | 174/107 |
| 4,670,494 | 6/1987 | Semenza, Jr. | 524/141 |
| 4,810,835 | 3/1989 | Richter et al. | 174/121 A X |
| 4,818,060 | 4/1989 | Arroyo | 350/96.23 |
| 4,826,899 | 5/1989 | Rees | 524/94 X |
| 4,941,729 | 7/1990 | Hardin et al. | 350/96.23 |
| 4,957,961 | 9/1990 | Chandrasekaran et al. | 524/405 |
| 5,024,506 | 6/1991 | Hardin et al. | 350/96.23 |
| 5,036,121 | 7/1991 | Croaker et al. | 524/100 |
| 5,057,345 | 10/1991 | Barrett | 428/35.1 X |
| 5,074,640 | 12/1991 | Hardin et al. | 385/109 |
| 5,162,609 | 11/1992 | Adriaenssens et al. | 174/34 |
| 5,220,130 | 6/1993 | Walters | 174/36 |
| 5,253,317 | 10/1993 | Allen et al. | 385/109 |
| 5,292,816 | 3/1994 | Metz et al. | 525/276 |
| 5,310,796 | 5/1994 | Warren et al. | 525/92 X |
| 5,422,614 | 6/1995 | Rampalli et al. | 333/237 X |
| 5,429,849 | 7/1995 | Lasson et al. | 428/36.9 |
| 5,468,782 | 11/1995 | Mehan | 521/134 |
| 5,493,071 | 2/1996 | Newmoyer | 174/113 X |
| 5,660,932 | 8/1997 | Durston | 428/373 |

FOREIGN PATENT DOCUMENTS

| | | | |
|---|---|---|---|
| 0395260 | 9/1989 | European Pat. Off. | H01B 7/02 |
| 0332932 | 10/1990 | European Pat. Off. | H01B 3/44 |

OTHER PUBLICATIONS

"National Electrical Code", (1996), Chap. 8, Article 800, pp. 70–852 to 70–865.

ANSI/UL 910–1994, "U.L. 910 Standard For Test Flame Propagation and Smoke–Density Values for Electrical and Optical–Fiber Cables Used in Spaces Transporting Environmental Air", 4th Ed (1995).

SOLVAY Polymers, "Materials Safety Data Sheet" (Jan. 1985).

*Primary Examiner*—Kristine Kincaid
*Assistant Examiner*—Chau N. Nguyen

[57] ABSTRACT

A coaxial cable with standard coaxial structure of central conductor, foamed polyethylene dielectric, and outer conductor and having a jacket that provides sufficient flame resistance and smoke generation to allow the cable to be used in plenum spaces. The jacket includes a halogenated polymer with a heat of combustion less than 7000 BTU per pound and including a free-radical scavenger.

18 Claims, 1 Drawing Sheet

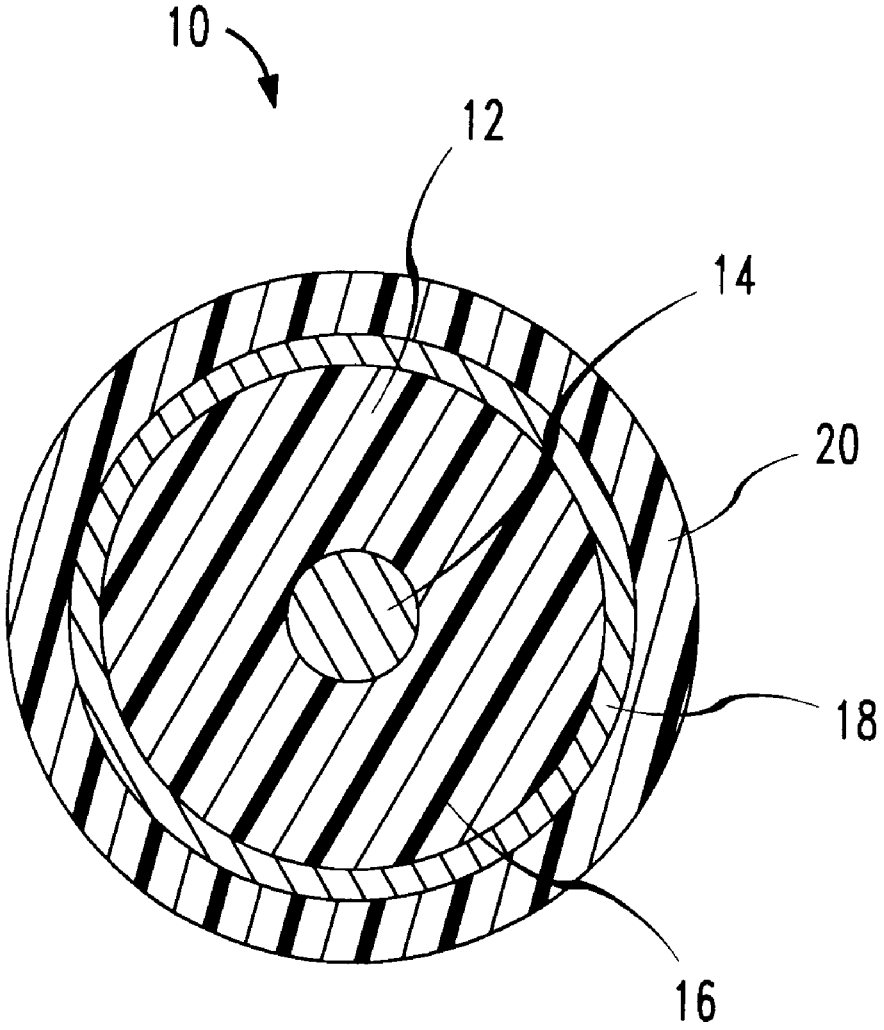
10
12
14
20
18
16

COAXIAL CABLE FOR PLENUM APPLICATIONS

FIELD OF THE INVENTION

This invention relates to cables for plenum applications. More particularly, the invention relates to a coaxial cable used for plenum applications which exhibits flame spread and smoke generation properties which comply with industry standards.

BACKGROUND OF THE INVENTION

Buildings are often times designed with a space between a drop ceiling and a structural floor from which the ceiling is suspended to serve as a return air plenum for elements of heating and cooling systems as well as serving as a convenient location for the installation of communications cables and other equipment, such as power cables. Alternatively, the building can employ raised floors used for cable routing and plenum space. Communications cables generally include voice communications, data and other types of signals for use in telephone, computer, control, alarm, and related systems, and it is not uncommon for these plenums and the cables therein to be continuous throughout the length and width of each floor, which can introduce safety hazards, both to the cables and the buildings.

When a fire occurs in an area between a floor and a drop ceiling, it may be contained by walls and other building elements which enclose that area. However, if and when the fire reaches the plenum space, and especially if flammable material occupies the plenum, the fire can spread quickly throughout the entire floor of the building. The fire could travel along the length of cables which are installed in the plenum if the cables are not rated for plenum use, i.e., do not possess the requisite flame and smoke retardation characteristics. Also, smoke can be conveyed through the plenum to adjacent areas and to other floors with the possibility of smoke permeation throughout the entire building.

As the temperature in a non-plenum rated jacketed cable rises, charring of the jacket material begins. Afterwards, conductor insulation inside the jacket begins to decompose and char. If the charred jacket retains its integrity, it still functions to insulate the core; if not, however, it ruptures due either to expanding insulation char or to pressure of gases generated from the insulation, and as a consequence, exposes the virgin interior of the jacket and insulation to the flame and/or the elevated temperatures. The jacket and the insulation begin to pyrolize and emit more flammable gases. These gases ignite and, because of air drafts in the plenum, burn beyond the area of flame impingement, thereby propagating flame and generating smoke and toxic and corrosive gases.

Because of the possibility of flame spread and smoke evolution, as a general rule, the National Electrical Code (NEC) requires that power-limited cables in plenums be enclosed in metal conduits. However, the NEC permits certain exceptions to this requirement. For example, cables without metal conduits are permitted, provided that such cables are tested and approved by an independent testing agent, such as Underwriters Laboratories (UL), as having suitably low flame spread and smoke generating or producing characteristics. The flame spread and smoke production of cables are measured using the UL 910 standard test method for fire and smoke retardation characteristics of electrical and optical fiber cables used in air handling spaces, i.e., plenums.

Communication systems in the present day environment are of vital importance, and, as technology continues to become more sophisticated, such systems are required to transmit signals substantially error free at higher and higher bit rates. More particularly, it has become necessary to transmit data signals over considerable distances at high bit rates, such as megabits or gigabits per second, and to have substantially error free transmission. Thus, desirably, the medium over which these signals are transmitted must be capable of handling not only low frequency and voice signals, for example, but higher frequency data and video signals. In addition, one aspect of the transmission that must be overcome is crosstalk between pairs of commercially available cables. One of the most efficient and widely used signal transmission means which has both broadband capability and immunity from crosstalk interference is the well known coaxial cable.

The coaxial cable comprises a center conductor surrounded by an outer conductor spaced therefrom, with the space between the two conductors comprising a dielectric, which may be air but is, most often, a dielectric material such as foamed polyethylene. The coaxial cable transmits energy in the transverse electromagnetic (TEM) mode, and has a cut-off frequency of zero. In addition, it comprises a two-conductor transmission line having a wave impedance and propagation constant of an unbounded dielectric, and the phase velocity of the energy is equal to the velocity of light in an unbounded dielectric. The coaxial line has other advantages that make it particularly suited for efficient operation in the hf and vhf regions. It is a perfectly shielded line and has a minimum of radiation loss. It may be made with a braided outer conductor for increased flexibility and it is generally impervious to weather effects. Inasmuch as the line has little radiation loss, nearby metallic objects and electromagnetic energy sources have minimum effect on the line as the outer conductor serves as a shield for the inner conductor. As in the case of a two-wire line, power loss in a properly terminated coaxial line is the sum of the effective resistance loss along the length of the cable and the dielectric loss between the two conductors. Of the two losses, the resistance loss is the greater since it is largely due to skin effect and the loss will increase directly as the square root of the frequency.

The most commonly used coaxial cable is a flexible type having an outer conductor consisting of copper or aluminum wire braid, with the copper or aluminum inner conductor supported within the outer by means of the dielectric, such as foamed, or expanded, polyethylene (XPE), which has excellent low-loss characteristics. The outer conductor is protected by a jacket of a material suitable for the application, such as, for example, for non-plenum use, poly(vinyl chloride) (PVC) or polyethylene (PE).

The coaxial cable most preferred for its performance characteristics for non-plenum uses has an XPE dielectric and PVC jacket. However, the use of XPE dielectric material and a PVC jacket generally does not result in a cable that satisfies UL 910. The use of foamed perfluorinated ethylene polymers, such as polytetrafluoroethylene (PTFE) and perfluorinated ethylene-propylene polymer (FEP), both sold under the trademark TEFLON®, has been suggested for the dielectric material due to its low flame spread and low smoke emission characteristics. However, foamed polyethylene is preferable because it is cheaper and requires simpler processing techniques. When accompanied with a plenum grade jacket, a cable having an XPE dielectric material will usually satisfy UL 910. TEFLON® is also useful as a plenum grade cable jacket material. However, TEFLON® is quite expensive and is currently in extremely short supply, hence is unsatisfactory from an economic standpoint, although outstanding for its flame and smoke retardation characteristics.

In general, highly flame retardant cable jackets have been made in two ways. An inert flame retardant additive such as antimony or molybdenum can be added to an appropriate polymer, such as PVC. Alternatively, or perhaps in combination, a halogenated polymer that is inherently flame retardant (such as TEFLON®) can be used alone or as a copolymer.

It is apparent from the foregoing discussion that what is still sought is an inexpensive, flame retardant, and low-smoke generating coaxial cable with excellent electrical transmission capabilities. The sought after cable desirably is easy to manufacture and does not sacrifice transmission properties for fire and smoke resistance.

SUMMARY OF THE INVENTION

The foregoing needs have been met by the cable of this invention which includes a core of a central conductor, generally copper, surrounded by a dielectric material which is preferably foamed polyethylene. An outer conductor surrounds the dielectric material and the so-formed coaxial arrangement is encapsulated within a sheath system including a jacket made of a flame resistant, low smoke producing material which is a halogenated polymer having a heat of combustion less than 7000 BTU per pound and including a free radical scavenger. The free radical scavenger may be either added to the polymer and/or may be intrinsic to the polymer. Examples of suitable polymers are vinylidene fluoride copolymers (PVDF-CP), ethylene chlorotrifluroethylene polymers (ECTFE), and low smoke PVCs. The jacket has a thickness of preferably about 17–25 mils. A jacket made in accordance with the invention satisfies UL 910 standards for plenum cables.

Other features of the present invention will be more readily understood from the following description of specific embodiments thereof when reviewed in conjunction with the drawings.

BRIEF DESCRIPTION OF THE DRAWINGS

FIG. 1 is an end cross-sectional view of a cable of the present invention.

DETAILED DESCRIPTION

Referring now to FIG. 1, there is shown a communications cable, which is designated generally by the numeral 10 and is flame retardant and smoke suppressive. Cable 10 includes core member 12 which comprises an inner or central metallic conductor member 14 surrounded by dielectric member 16. The inner or central conductor member 14 is preferably copper or aluminum such as is typical for coaxial cables. Dielectric member 16 made be any suitable insulating material having adequate dielectric properties and is most preferably foamed, or expanded, polyethylene. Dielectric member 16 is surrounded by an outer metallic conductor member 18 which is preferably copper or aluminum and consists, preferably, of an aluminum tape surrounded by a copper braid. The coaxial structure formed by the core member and the outer conductor is in turn encased in a jacket 20 manufactured according to the present invention which renders the cable flame retardant and smoke suppressive.

A foamed polyethylene dielectric member has poor flame spread resistance and smoke generating properties. However, the excellent dielectric properties of foamed polyethylene make it desirable as dielectric material for coaxial cables. The jacket material of the present invention overcomes the poor flame spread and smoke properties of the dielectric and enables the cable manufactured according to the present invention to be used as a plenum cable.

Jacket 20 is made of a halogenated polymer having a heat of combustion less than 7000 BTU per pound and including a free radical scavenger. The inventors have discovered that polymers with a heat of combustion lower than 7000 BTU per pound are suitable for the jacket of the invention as long as they either include intrinsically a free radical scavenger or have a free radical scavenger added thereto. A free radical scavenger acts as a quenching agent for free radicals, thus removing free radicals, such as OH and O, that are essential for flame propagation. The quenching of free radicals slows the rate of energy production and results in extinction of the flame. Halogenated compounds have been shown to act as free radical scavengers by the following reactions: HBr+OH®$H_2O$+Br and HBr+0®OH+Br. Inorganic compounds act to reduce flame propagation in at least two ways, by lowering the fuel content of the polymer and by acting, in combination with halogen acids, to promote char formation and to provide an inert blanket over the jacket, thus excluding oxygen and preventing flame spread. An example of a commonly used compound is antimony oxide which is converted to a volatile species by a halogen acid released by a halogenated organic. The resulting antimony trihalide or antimony halide oxide is the flame suppressant.

Smoke suppression is a function of the fire retarding and smoke suppressing ability of the jacket polymer material itself as well as the ability of the jacket to keep flame away from the smoke-providing dielectric, by being of adequate thickness and/or by forming a char. In other words, smoke suppressing ability of a cable jacket is determined by the jacket chemical and physical properties. Many inorganics also function as smoke suppressants, for example, antimony, molybdenum, tungsten, zinc, and aluminum, and are commonly added to polymers to increase the smoke suppression of the polymer.

Preferably, the heat of combustion of the material ranges from approximately 2300 BTU per pound to approximately 7000 BTU per pound. Examples of appropriate halogenated polymers include copolymers of vinylidene fluoride ($VF_2$), ethylene chlorotrifluoroethylene polymers, and PVC formulated for low smoke emission. Optionally, the polymer may have a smoke suppressant added thereto. Examples of appropriate polymers are HALAR 379—a trade name for a plasticized ECTFE; SOLEF 11008/0003—a trade name for a $VF_2$/hexafluoropropylene copolymer with a smoke suppressant; SOLEF 32008/0003—a trade name for a $VF_2$/20% ECTFE copolymer with a smoke suppressant; SOLEF 32008/0009—a trade name for a $VF_2$/20% ECTFE copolymer with additional smoke suppressant; and Alpha Gary 692OF1—a low smoke formulated PVC. The preferred polymer is SOLEF 32008/0009, sold by Solvay Polymers, Houston, Tex. This polymer has an oxygen index according to ASTM D2863 of 95% and a UL 94 classification of V-0.

The jacket preferably has a thickness between about 17 and 25 mils (0.017 to 0.025 inches). A cable prepared with the jacket of the invention passes UL 910 test for flame propagation and peak optical density and average optical density, which are measurements of smoke emission.

TEST RESULTS

Coaxial cables were constructed in accordance with typical coaxial manufacturing techniques with expanded high density polyethylene (XHDPE) dielectric material and a jacket of SOLEF 32008/0009 polymer. The cables included a 26 gauge (0.0157 inch diameter) copper central conductor and XHDPE dielectric with a diameter of about 0.077 inches and about 45–50 degree of expansion. The outer conductor included a first wrapping of an aluminum and polyester laminant tape covered with a metallic braid of 38 gauge tinned copper wire with a minimum of 90% coverage. One cable had a jacket thickness of 14 mils and a second was constructed having a jacket thickness of 20 mils. The cables were subjected to the flame test described in UL 910 and maximum flame propagation of the cables was measured. Smoke development was measured with a photometer system and the optical smoke density was calculated from the light attenuation values. UL 910 test results are shown in Table 1.

TABLE 1

| {PRIVATE} 735 Type Coaxial Cable Construction | Flame Spread | Peak Optical Density | Average Optical Density |
|---|---|---|---|
| UL 910 Requirement | 5 Feet | 0.5 | 0.15 |
| XHDPE Dielectric with Solef 32008/0009 0.014 Inch Nominal Jacket Thickness | 7.0 | 0.66 | 0.07 |
| XHDPE Dielectric with Solef 32008/0009 0.020 Inch Nominal Jacket Thickness | 2.5<br>3.5 | 0.34<br>0.42 | 0.05<br>0.05 |

The cable constructed with the jacket having a thickness of 0.020 inches passed the requirements of UL 910 for a plenum cable. The cable having a jacket thickness of 0.014 inches failed UL 910. A further test indicated that a cable with a jacket of 0.016 inch thickness gave marginal results in the UL 910. From these results, the conclusion is that the jacket should have a thickness above 0.016 inches. The preferred thickness of the cable is thus between about 0.017 and 0.025 inches. A jacket much thicker than 0.025 would be difficult to handle and a thinner jacket falls the UL 910 requirement. However, it is possible that a cable having a jacket thinner than 0.017 inch could be within the scope of the invention if the cable is manufactured with a jacket of appropriate materials as disclosed in this specification. For example, another particular combination of a polymer with a heat of combustion between about 2300–7000 BTU per pound and a free radical scavenger could provide adequate protection from flame spread and smoke generation at a thickness less than 0.017 inches.

Another observation from the UL 910 test was that a char was formed that isolated the outer conductor and the insulation on the inner conductor. Thus, the insulation and the conductors were protected from flames. Since the dielective was protected, it did not produce smoke.

It is to be understood that the above described arrangements are simply illustrative of the invention. Other arrangements may be devised by those skilled in the art which will embody the principles of the invention and fall within the spirit and scope thereof.

What is claimed is:

1. A shielded coaxial cable which complies with the flame spread and smoke optical density requirements of UL 910 for a Plenum Cable, said coaxial cable consisting essentially of:

a core member including a central conductor; and a solid dielectric material, said solid dielectric material surrounding the length of said central conductor;

an outer conductor shield surrounding said dielectric material; and a jacket comprising a halogenated polymer having a heat of combustion between approximately 2300 and 7000 BTU per pound and including a free radical scavenger for flame retardance.

2. The cable of claim 1, wherein the dielectric material is foamed polyethylene.

3. The cable of claim 1, wherein the polymer is a copolymer of vinylidene fluoride.

4. The cable of claim 1, wherein the polymer is a copolymer of vinylidene fluoride and chlorotrifluoroethylene.

5. The cable of claim 4, wherein the percentage of chlorotrifluoroethylene in the copolymer is 20%.

6. The cable of claim 1, wherein the jacket further comprises a smoke suppressant.

7. The cable of claim 1, wherein the polymer is selected from the group consisting of low smoke polyvinyl chloride, chlorotrifluoroethylene polymer, and vinylidene fluoride copolymers.

8. The cable of claim 1, wherein the jacket has a thickness of from about 0.017 to 0.025 inches.

9. The cable of claim 1, wherein the polymer is SOLEF 32008/0003 or SOLEF 32008/0009.

10. The cable of claim 1, wherein the outer conductor shield is braided.

11. The cable of claim 10, wherein the braided outer conductor shield is copper.

12. A shielded coaxial cable which complies with the flame spread and smoke optical density requirements of UL 910 for a Plenum Cable, said coaxial cable consisting essentially of:

a core member including a central conductor; and a dielectric material;

said dielectric material comprising foamed polyethylene encapsulating the length of said central conductor;

an outer conductor shield surrounding said dielectric material; and a jacket surrounding said outer conductor comprising a halogenated polymer having a heat of combustion between approximately 2300 and 7000 BTU per pound and including a free radical scavenger for flame resistance, said jacket having a thickness from between about 0.017 to 0.025 inches.

13. The cable of claim 12, wherein the halogenated polymer comprises a copolymer of vinylidene fluoride and 20% chlorotrifluoroethylene and a smoke suppressant.

14. The cable of claim 12, wherein the polymer is selected from the group consisting of low smoke polyvinyl choride, chlorotrifluoroethylene polymer, and vinylidene fluoride copolymers.

15. The cable of claim 14, wherein the halogenated polymer comprises 20% chlorotrifluoroethylene.

16. The cable of claim 12, wherein the polymer is SOLEF 32008/0003 or SOLEF 32008/0009.

17. The cable of claim 12, wherein the outer conductor shield is braided copper.

18. A shielded coaxial cable which complies with the flame spread and smoke optical density requirements of UL 910 for a Plenum Cable, said coaxial cable consists essentially of:

a core member including a central conductor; and a dielectric material comprised of foamed polyethylene encapsulating the length of said central conductor;

an outer conductor shield of braided copper surrounding said dielectric material; and a jacket surrounding said outer conductor comprising a halogenated polymer, said halogenated polymer comprising a copolymer of vinylidene fluoride and 20% chlorotrifluoroethylene and a smoke suppressant, said halogenated polymer having a heat of combustion between approximately 2300 and 7000 BTU per pound and including a free radical scavenger for flame retardance, said jacket having a thickness from between about 0.017 to 0.025 inches.

* * * * *